US008656937B1

(12) United States Patent
Minasi et al.

(10) Patent No.: US 8,656,937 B1
(45) Date of Patent: Feb. 25, 2014

(54) OUTDOOR UMBRELLA STABILIZER SYSTEM

(76) Inventors: Connie Minasi, Toms River, NJ (US); Vincent Minasi, Toms River, NJ (US)

( * ) Notice: Subject to any disclaimer, the term of this patent is extended or adjusted under 35 U.S.C. 154(b) by 122 days.

(21) Appl. No.: 13/291,517

(22) Filed: Nov. 8, 2011

(51) Int. Cl.
*E04H 15/62* (2006.01)

(52) U.S. Cl.
USPC ..... 135/118

(58) Field of Classification Search
USPC ..... 135/98, 127, 128, 15.1, 23, 25.31, 16, 135/118, 159, 115, 114, 33.41, 150, 147, 135/21, 90; 108/50.12; 248/345, 325, 499, 248/522, 519, 453, 125.7, 504, 505, 506, 248/500; 24/129 R, 130, 129 B
See application file for complete search history.

(56) References Cited

U.S. PATENT DOCUMENTS

| | | | | |
|---|---|---|---|---|
| 3,407,825 | A | 10/1968 | Doyle | |
| 4,924,893 | A | 5/1990 | Furey | |
| 5,131,422 | A | 7/1992 | Aronov | |
| 5,277,212 | A | 1/1994 | Aronov | |
| 5,441,066 | A * | 8/1995 | Harris | 135/88.01 |
| 6,164,613 | A | 12/2000 | Williams | |
| 6,397,865 | B1 * | 6/2002 | Wilson et al. | 135/16 |
| 6,964,277 | B2 | 11/2005 | Naber | |
| D625,508 | S | 10/2010 | Thurrott et al. | |
| 7,946,305 | B1 | 5/2011 | Mailman | |
| 2004/0034972 | A1 * | 2/2004 | Brown | 24/129 R |
| 2005/0249439 | A1 * | 11/2005 | Penson | 383/38 |
| 2006/0008182 | A1 * | 1/2006 | Ingraselino | 383/4 |

OTHER PUBLICATIONS

Biddulph et al., Jun. 26, 1991, Australian Application and publication, "Safety method for use on beach or other umbrellas in windly conditions."*

* cited by examiner

*Primary Examiner* — Jonathan Liu
*Assistant Examiner* — Erin W Smith
(74) *Attorney, Agent, or Firm* — Goldstein Law Offices, P.C.

(57) ABSTRACT

An outdoor umbrella stabilizer system for preventing wind damage to an outdoor umbrella having a plurality of cords, a plurality of clips and a means of securing the cords to a weighted object. The stabilizer system flexibly maintains the canopy in position, preventing strong winds from catching the canopy and twisting, warping, contorting, buckling or deforming the umbrella, thereby stabilizing the outdoor umbrella. The stabilizer system installs on many styles of outdoor umbrellas, including a cantilever, a beach umbrella, a deck or patio umbrella, a center pole or vertical pole of the umbrella unnecessary for installation. The stabilizer system has a sac containing ballast as a weighted object. The cords attach to the sac. For an umbrella accommodated by a table having a center hold for the umbrella, the table is the weighted object, the cords attaching to the legs.

2 Claims, 8 Drawing Sheets

OUTDOOR UMBRELLA STABILIZER SYSTEM

BACKGROUND

The present disclosure relates generally to an outdoor umbrella stabilizer system. More particularly, the disclosure relates to a system for stabilizing beach, patio, deck and other outdoor umbrellas in windy conditions.

People enjoy spending their leisure time outdoors. Many invest in outdoor furniture for entertaining and relaxing, often spending large sums of money for outdoor furnishings, on par with amounts spent on decorating interior rooms. In addition to chairs, tables, chaise lounges and couches that are found indoors and outdoors, there is an essential furnishing that is unique to outdoor furnishings, an outdoor umbrella. The outdoor umbrella with an over-size canopy on a deck or a patio provides shade for someone sitting outside during the day. Increasing awareness of the dangers of overexposure to the sun's burning rays has given the umbrella the status of an essential piece of equipment on the deck or the patio. These umbrellas are both functional and decorative, costing hundreds of dollars, sometimes even into the thousands.

Similarly, people enjoy the outdoors at the beach. The outdoor umbrella, along with a blanket, a cooler full of drinks and sunscreen, is essential for a comfortable and healthful day on the beach. This outdoor umbrella, usually a stand-alone style, referred to as a beach umbrella, protects the beach-goer from the direct sunburn-causing rays with an over-sized canopy and provides cooling shade. While less expensive than a decorative deck or patio umbrella, owners want to obtain many occasions of use when purchasing one. Many hotels and private beaches invest in a large numbers of these umbrellas that bear the establishment's trademark and desire to keep the beach umbrellas in top condition, reflecting on the quality of the establishment.

Deck and patio outdoor umbrellas generally are available in two styles, center pole and cantilever. The center pole style is the most typical style for beach umbrellas as well as being a common style for deck and patio umbrellas. The center pole style umbrella generally sits in a stand, the pole extending to the center of the umbrella canopy, the canopy extending outward from the center by a plurality of ribs. On the beach, the bottom of the center pole is placed into an auger or similar holder and driven into the sand. On the deck or patio, the bottom of the center pole fits into a holder in a weighted stand. Often, the center pole is inserted into a center hole in a tabletop, attaching to the tabletop or extending down into a weighted stand, so that the umbrella shades the table.

The cantilever style has a vertical pole extending from a bottom stand and a horizontal arm extending out. The umbrella hangs from a distal end of the extended horizontal arm, the top center of the umbrella canopy extending out from the end of the arm, the ribs extending the canopy from underneath. The cantilever style is used to shade tables, chaise lounges, couches, or chairs or wherever shade is needed.

Deck and patio umbrellas are generally set up at the beginning of the outdoor living season and forgotten about. Heavy summer storms often occur at night or when no one is at home to furl the umbrella to protect it from wind damage. Similarly at the beach, a sudden unexpected gust of wind, twenty miles per hour or more, comes off the water, wrecking havoc with the beach umbrella, causing the umbrella to turn inside out twisting, warping, contorting, buckling, deforming or toppling it, thereby damaging the ribs and the canopy. The beach-goer has no time to furl the umbrella to protect it.

Many have proposed ways to prevent wind damage to these umbrellas. Generally, a device that works on the beach umbrella will only work on that style of umbrella and will not work on a patio umbrella or deck umbrella, especially a cantilever. There is not a single solution that adapts to all styles of these oversize umbrellas.

While these units may be suitable for the particular purpose employed, or for general use, they would not be as suitable for the purposes of the present disclosure as disclosed hereafter.

SUMMARY OF THE DISCLOSURE

It is an object of an embodiment of the present disclosure to produce an outdoor umbrella stabilizer system for many styles of outdoor umbrellas. Accordingly, the embodiment is an outdoor umbrella stabilizer system that installs on many styles of outdoor umbrellas, a center pole or vertical pole of the umbrella unnecessary for installation.

It is another object of an embodiment of the present disclosure to produce an outdoor umbrella stabilizer system that prevents wind damage to an outdoor umbrella. Accordingly, the embodiment is an outdoor umbrella stabilizer system that flexibly fixes an elastic cord to an umbrella canopy, allowing sufficient slack for the umbrella to move only slightly in high winds without creating stress on the umbrella.

It is a further object of an embodiment of the present disclosure to produce an outdoor umbrella stabilizer system that prevents an umbrella canopy from catching a strong wind, the strong wind damaging the umbrella accommodated by a table. Accordingly, the embodiment is an outdoor umbrella stabilizer system that maintains a canopy of an umbrella in position by attaching the canopy to a plurality of table legs, preventing strong winds from catching the canopy and twisting, warping, contorting, buckling or deforming the umbrella.

It is yet a further object of an embodiment of the present disclosure to produce an outdoor umbrella stabilizer system that prevents an umbrella canopy from catching a strong wind, the strong wind damaging a freestanding umbrella, such as a cantilever or a beach umbrella. Accordingly, the embodiment is an outdoor umbrella stabilizer system that maintains a canopy of an umbrella in position by attaching the canopy to a plurality of sacs containing ballast, preventing strong winds from catching the canopy and twisting, warping, contorting, buckling or deforming the umbrella.

It is yet another object of an embodiment of the present disclosure to produce an outdoor umbrella stabilizer system that is portable and easily transports to the beach or other outdoor venues. Accordingly, an embodiment of the present disclosure to produce an outdoor umbrella stabilizer system has a plurality of cords, clips and sacs, the sacs folding flat without ballast, the cords, clips and sacs easily fitting into a small package for easy transportation.

The disclosure describes an outdoor umbrella stabilizer system for preventing wind damage to an outdoor umbrella having a plurality of cords, a plurality of clips and a means of securing the cords to a weighted object. The stabilizer system flexibly maintains the canopy in position, preventing strong winds from catching the canopy and twisting, warping, contorting, buckling or deforming the umbrella, thereby stabilizing the outdoor umbrella. The stabilizer system installs on many styles of outdoor umbrellas, including a cantilever, a beach umbrella, a deck or patio umbrella, a center pole or vertical pole of the umbrella unnecessary for installation. The stabilizer system has a sac containing ballast as a weighted object. The cords attach to the sac. For an umbrella accommodated by a table having a center hold for the umbrella, the table is the weighted object, the cords attaching to the legs.

To the accomplishment of the above and related embodiments, the disclosure may be embodied in the form illustrated in the accompanying drawings. Attention is called to the fact, however, that the drawings are illustrative only. Variations are contemplated as being part of the disclosure, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE EMBODIMENTS

Figure 1:
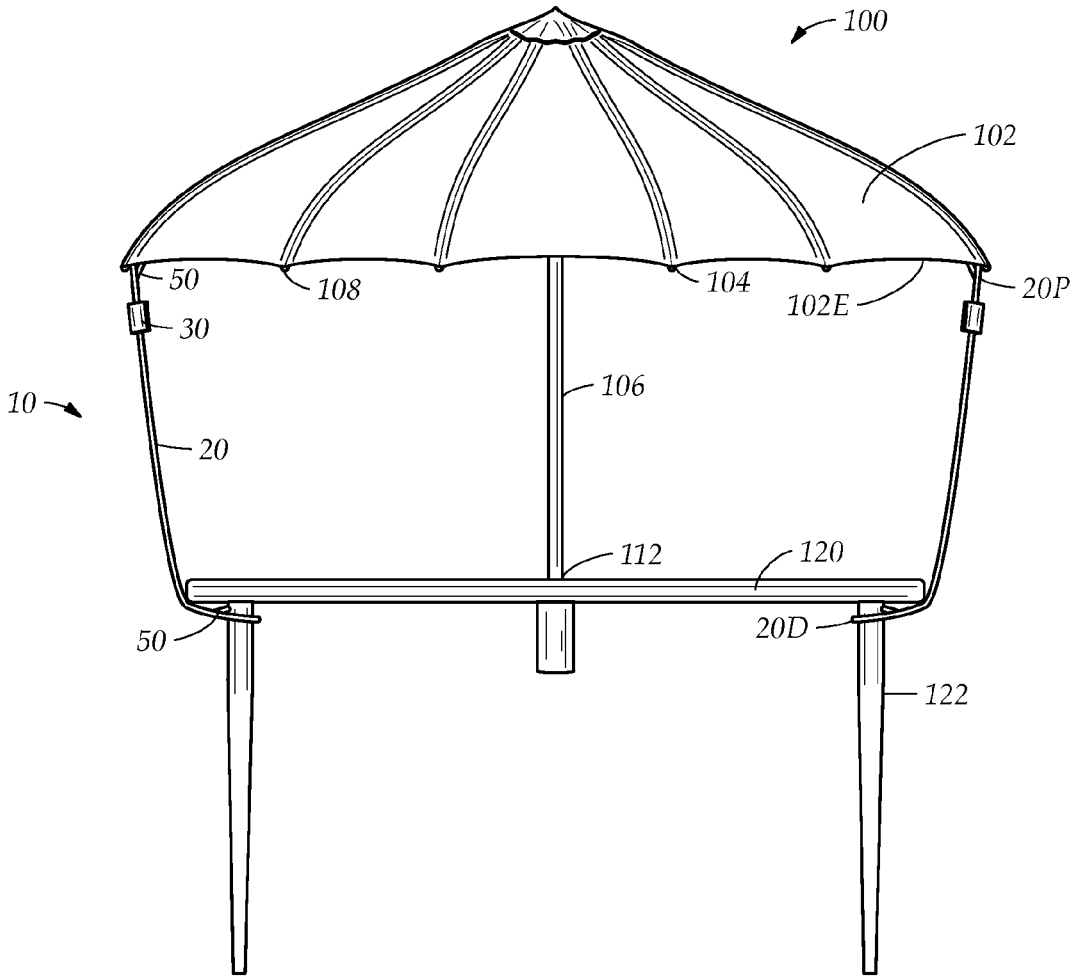
FIG. 1 is a side elevational view of an umbrella stabilizer system in place on an umbrella attached to a table.

FIG. 1 illustrates an outdoor umbrella stabilizer system 10 installed on an outdoor umbrella 100, the system preventing damage to the outdoor umbrella from strong wind gusts and strong prevailing winds associated with storms and other extreme weather conditions. The stabilizer system has a plurality of sets, each set 10 having an elastic cord 20 and a clip 30 securing the cord to the outdoor umbrella and a means of securing the cord to a weighted object. The sets of the system have a balanced placement, the cords flexibly maintaining the umbrella in position, preventing strong winds from catching the umbrella and twisting, warping, contorting, buckling or deforming the umbrella, thereby stabilizing the outdoor umbrella.

In FIG. 1, a tabletop outdoor umbrella, typically used on a deck or patio to shade a table 120, is illustrated. The umbrella has a center pole 106, a canopy 102, and a plurality of ribs 104 radially extending out from the center pole under the canopy, supporting and extending the canopy. The canopy, having an edge 102E, attaches to the ribs, the ribs having a distal end, the canopy edge attaching to the distal end of the ribs by a tip 108. The table, having a plurality of legs 122 and a center hole 112, accommodates the center pole of the umbrella through the center hole.

Each cord 20 of the umbrella stabilizer system attaches to one rib 104 of the umbrella. The cord inserts between the canopy 102 and the rib above the tip 108 where the canopy and the rib edge join. The cord has a pair of ends, a first proximal end 20P attaching to the umbrella and a second distal end 20D attaching to a weighted object. The clip places onto the proximal end of the cord after the cord inserts between the canopy and the rib, forming a loop 50, the loop securing the cord to the umbrella canopy. The loop elastically attaches the cord to the umbrella, providing the umbrella some slack for movement without creating stress on the rib, causing the rib to break. As illustrated in FIG. 1, the distal end of the cord attaches to the weighted object, the weighted object in this drawing is the table leg 122. The distal end forms a loop 50 around the weighted object, in this illustration, the loop forms around the table leg 122. The loop is secured to the leg in one embodiment by the clip. In a further embodiment, the cord end has an annulus and the loop is secured to leg by the proximal end of the cord passing through the annulus when first forming the loop.

Figure 2:
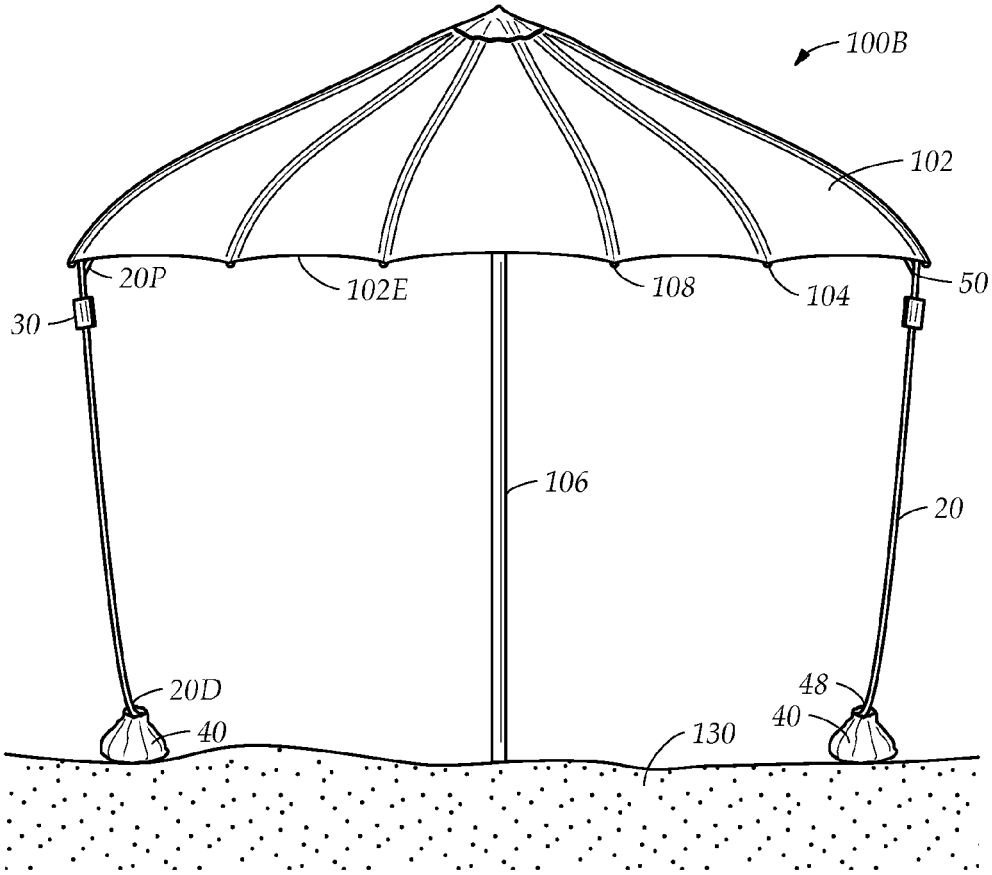
FIG. 2 is a side elevational view of the umbrella stabilizer system in place on a beach umbrella.

FIG. 2 shows a further embodiment of the umbrella stabilizing system. The system is installed on a beach-style outdoor umbrella 100B, the center pole of the umbrella 106 inserted and anchored into a surface 130, the means of anchoring the center pole are well-known to those of ordinary skill and beyond the scope of this discussion. As described hereinabove, the proximal end 20P of the elastic cord inserts between the canopy 102 and the rib 104 above and around the tip 108 and is secured by the clip 30. The distal end 20D of the cord is attached to a sac 40, the sac a weighted object containing ballast, as described further hereinbelow. The sac 40 sits on the surface 130, which is sand as illustrated in FIG. 2, but the surface is any outdoor surface, such as, for example, sand, concrete, decking, or asphalt.

In another example of an embodiment similar to the beach outdoor umbrella, the umbrella stabilizer system is installed in the same manner on a cantilever umbrella. The cantilever umbrella has a vertical support pole alongside the umbrella, the support pole having a horizontal arm. The canopy of the umbrella suspends from the horizontal arm, without any internal pole for support. As discussed hereinabove, the proximal end of the elastic cord inserts between the canopy and the rib above and around the tip and is secured by the clip, the distal end of the cord attaching to the sac. The umbrella stabilizer system does not require any vertical support pole or center pole to function, allowing the system to install on many styles of outdoor umbrellas, the umbrellas commonly having the canopy attaching to ribs at the tips.

Figure 3A:
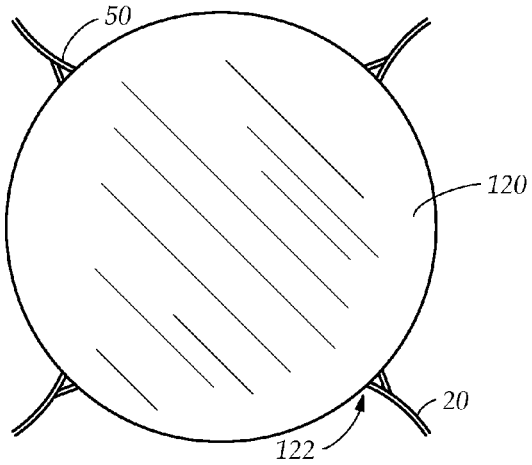
FIG. 3A is a top plan view of a round table with the umbrella stabilizer system in place. The umbrella is not shown for the sake of clarity.
Figure 3B:
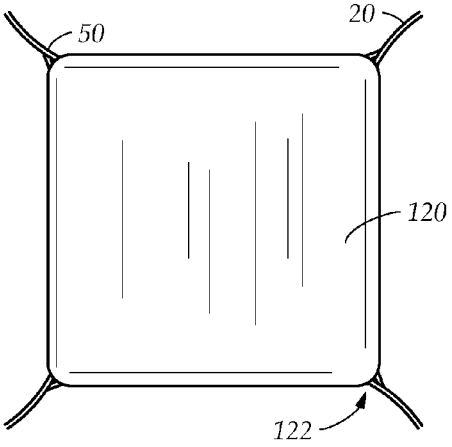
FIG. 3B, similar to FIG. 3A, is a top plan view of a square table with the umbrella stabilizer system in place. The umbrella is not shown for sake of clarity.
Figure 3C:
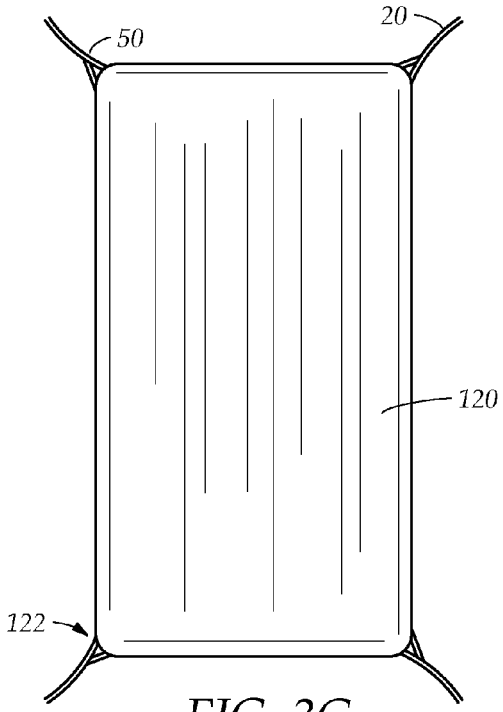
FIG. 3C, similar to FIG. 3B, is a top plan view of a rectangular table with the umbrella stabilizer system in place. The umbrella is not shown for sake of clarity.

FIGS. 3A, 3B and 3C show balanced placements of the cords on weighted objects that are tables. The umbrella is not shown for clarity, showing only a table 120 in each drawing. In FIG. 3A, the cords attach to a round table having four legs 122, the loop 50 of one cord 20 attached to each leg. It is understood by those of ordinary skill that if a round table has three legs, each leg equidistant from the other, one set of the cord and clip attaches to each leg. FIG. 3B shows the cord 20 attaching to a square table 120 having four legs, the loop 50 of each cord 20 attaching to one leg 122. In one embodiment, two cords attach to the square table to legs opposite each other. In FIG. 3C, the cords attach to a rectangular table 120 having four legs, the loop 50 of each cord 20 attaching to one leg 122. It is understood by explanation and example, that if the table has three or more legs that various configurations of the cords are possible, the cords angularly equidistant from each other such that a number of degrees between each cord is the same. If a table has an even number of legs, the sets of cords and clips, angularly equidistant from each other attach to at least a pair of legs, one set to each leg. FIGS. 3A, 3B and 3C illustrate how the sets attach using the table as a weighted object. When the sac is the weighted object, the number of cords varies. In one embodiment, the range of sets varies from one to four, the sets attaching to the umbrella, each set angularly equidistant from each other.

Figure 4A:
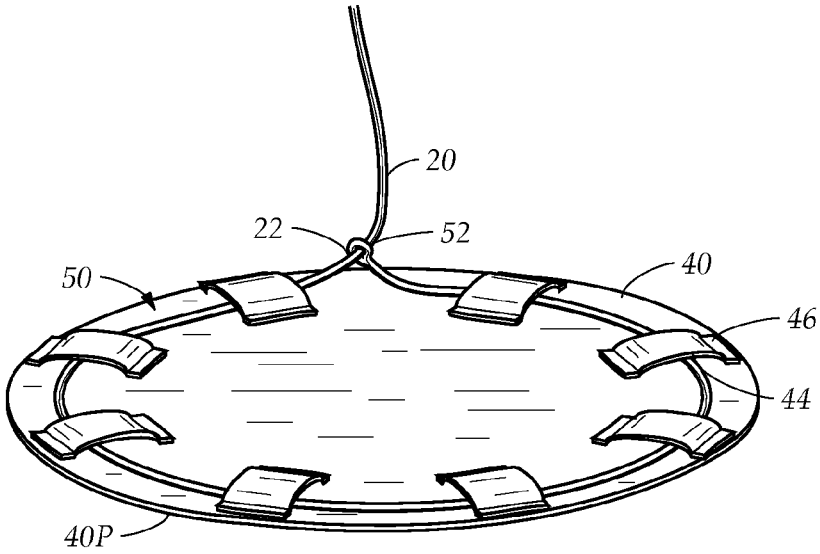
FIG. 4A is a diagrammatic perspective view of a weight sac having a casing with an elastic cord inserted.

FIG. 4A illustrates the sac 40 of the stabilizer system without ballast. The sac is substantially circular, having a circumferential perimeter 40P, an inside and an outside. The inside has a casing 44 created by a plurality of tabs 46 attaching to the inside, along the perimeter 40P. The elastic cord 20 inserts into the casing 44. The distal end 20D of the elastic cord has the annulus 22, the proximal end of the cord threading through the distal end annulus 22 forming a single turn half-hitch knot 52, the knot forming the loop 50 from the cord in the casing. The knot allows the loop to selectively tighten by moving the annulus along the cord. In another embodiment, the loop is formed by securing with the clip. The sac with tabs is suitable for ballast that has small particles, such as sand as a non-limiting example.

Figure 4B:
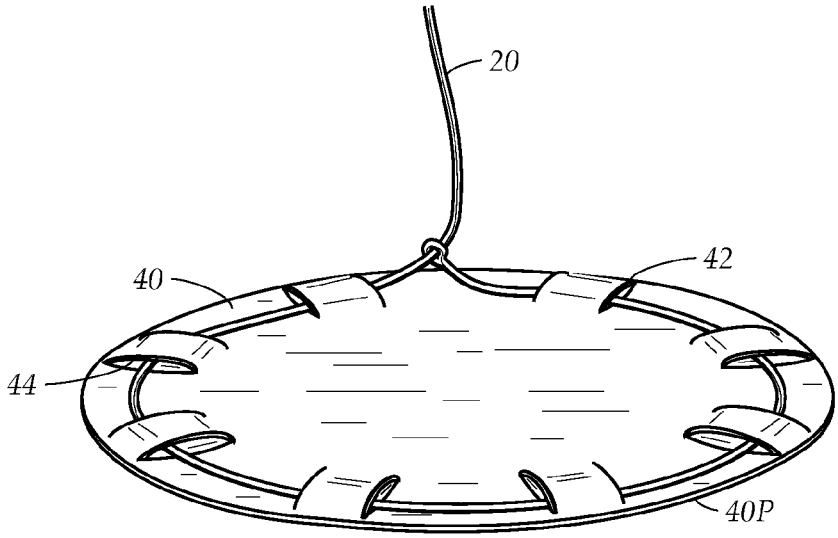
FIG. 4B, similar to FIG. 4A, is a diagrammatic perspective view of a weight sac having a plurality of slots with the elastic cord threaded through the slots.

FIG. 4B shows another embodiment of the sac 40, the casing 44 formed by slits 42 along the perimeter 40P, the slits orthogonal to the perimeter. The cord 20 weaves in and out the slits, inserting from the inside into a first slit and inserting from the outside into a second slit and continuing around the slits, weaving the cord, completing the perimeter. The cord threads through the distal end annulus 22 as described hereinabove.

Figure 4C:
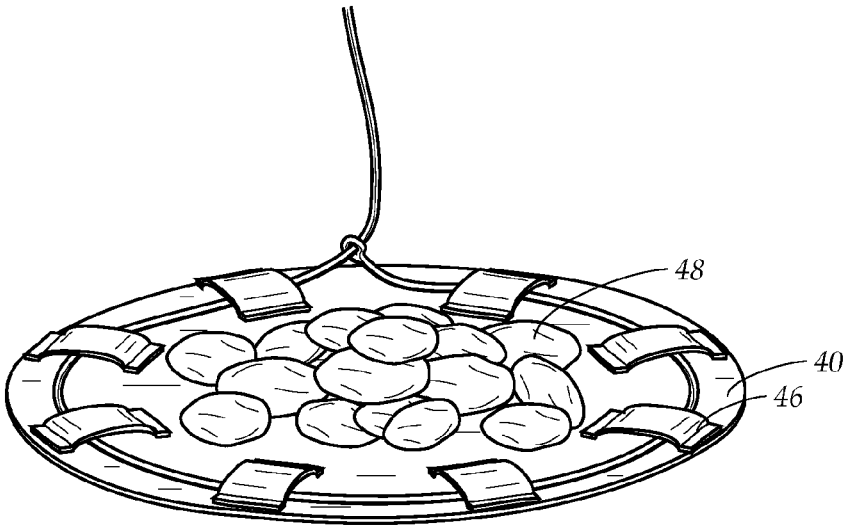
FIG. 4C, similar to FIG. 4A, is a diagrammatic perspective view of the weight sac holding ballast.
Figure 4D:
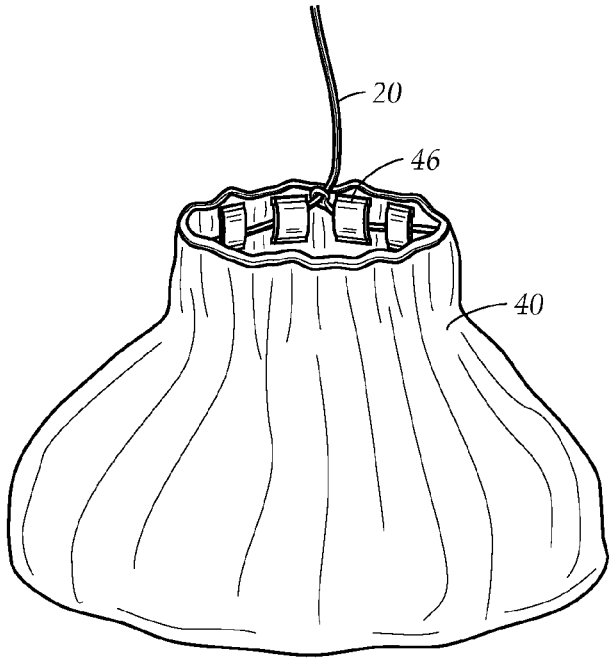
FIG. 4D, similar to FIG. 4C, is a diagrammatic perspective view of the weight sac holding ballast and the elastic cord cinching the sac into a closed position.

FIG. 4C demonstrates ballast 48 placed on the inside of the sac 40. In the drawing, rocks are used as ballast, as a non-limiting example. It is understood that many materials having sufficient density are suitable as ballast such as, for example, but not limited to, sand, rocks, marbles, coins, soil, pebbles and a water-filled bladder. FIG. 4D shows the sac 40 cinched closed with the ballast inside, the cord 20 selectively tightened to envelop the ballast. FIG. 4C and FIG. 4D show the sac with the tabs 46. It is understood that the sac having slits as well as a sac having other means for creating the casing for the cord, functions in the same manner and are contemplated as part of the present disclosure.

Figure 8:
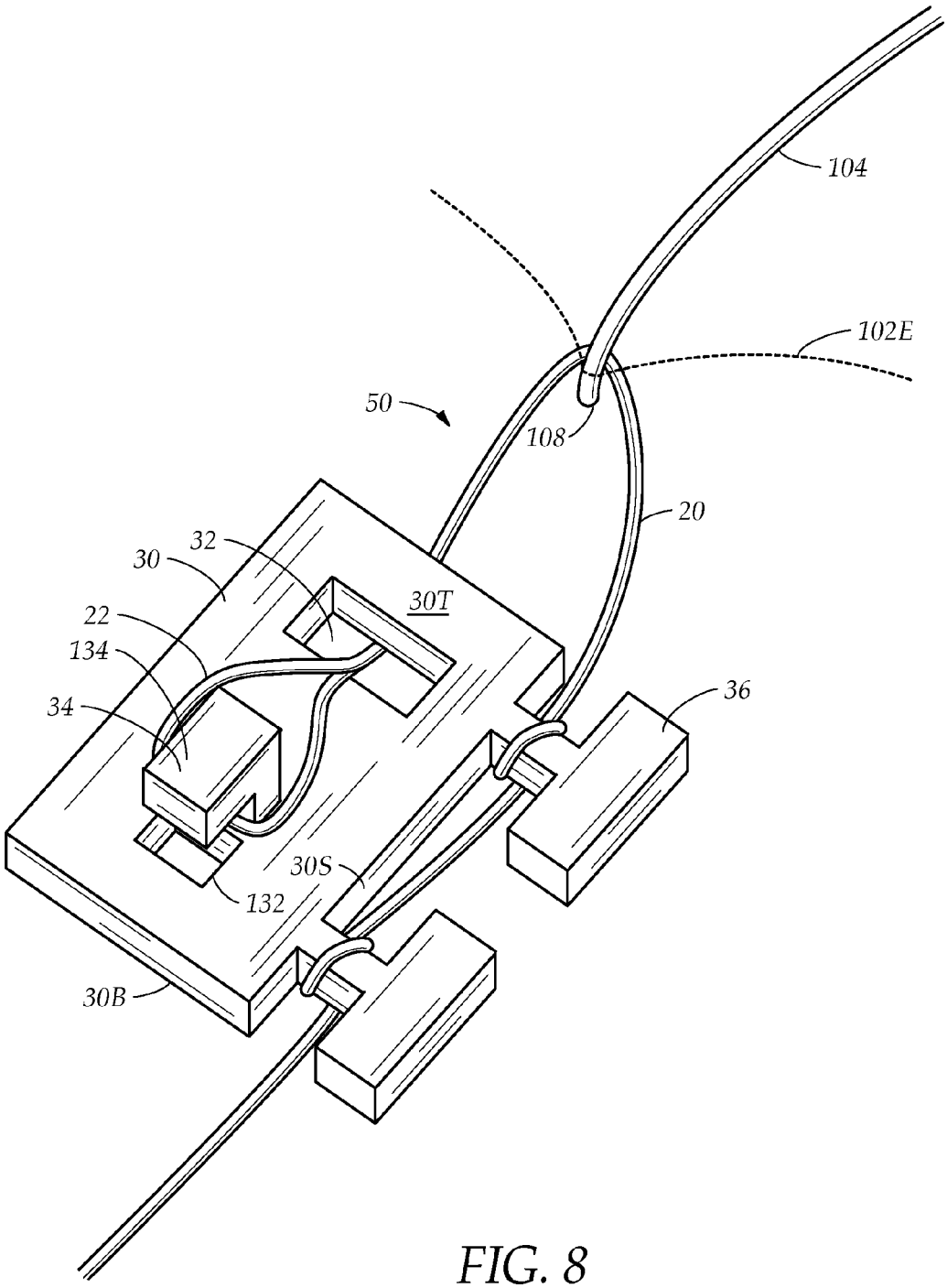
FIG. 8 is a diagrammatic perspective view of yet a further embodiment of the clip with the elastic cord tab inserted in the clip, the cord engaged with an umbrella.

FIG. 8 shows an embodiment of the clip 30 of the stabilizer system. The clip is a block 32, having a top 32T, a bottom 30B, a side 30S, at least one aperture 32, a J-hook 34 on the top and at least one T-bar 36 on the side. The end of the cord 20 has the annulus 22. The proximal end of the cord wraps around at least one T-bar 36. The proximal end of the cord inserts between the rib 104 and the canopy edge, initiating the loop 50. The annulus 22 inserts from the bottom 30B of the block through the aperture 32 to the top of the block 30T and loops over the J-hook 34, the J-hook having a vertical portion 134 orthogonal to the top of the block and a top horizontal portion 136 at a right angle to the vertical portion and facing away from the aperture. The annulus 22 loops over the top horizontal portion 134 and onto the vertical portion 136, the horizontal portion securing the annulus. In one embodiment, the clip has a plurality of T-bars. In one embodiment, there is another aperture 132 below the J-hook.

Figure 6:
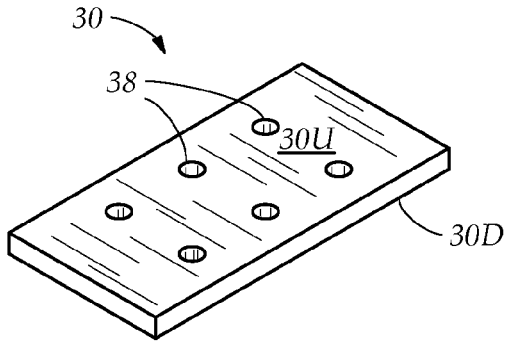
FIG. 6 is a diagrammatic perspective view of a further embodiment of the clip.
Figure 7:
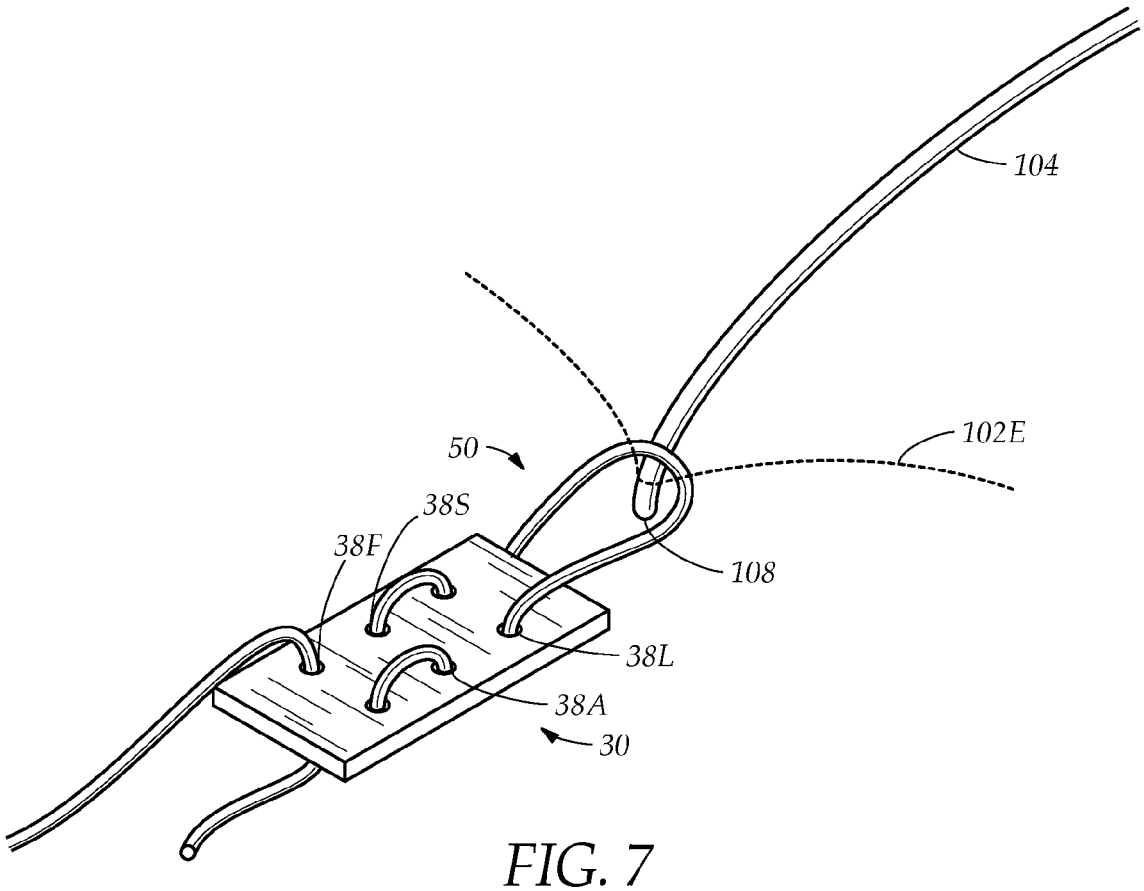
FIG. 7 is a diagrammatic perspective view of a further embodiment of the clip with the elastic cord inserted in the clip, the cord engaged with an umbrella.

FIG. 6 shows a further embodiment of the clip 30 in the stabilizer system. The clip is a slab, having a pair of sides and a plurality of openings 38. The openings are arranged in a pair of parallel rows, each row having at least two openings. In this embodiment, as shown in FIG. 7, the end 30E of the cord is simple. The cord end is inserted into a first opening 38F in a row from a first side onto the second side and then from a second side into a second opening 38S in the row, weaving through the row of openings. The cord is inserted between the rib and the canopy edge as explained hereinabove.

Figure 5A:
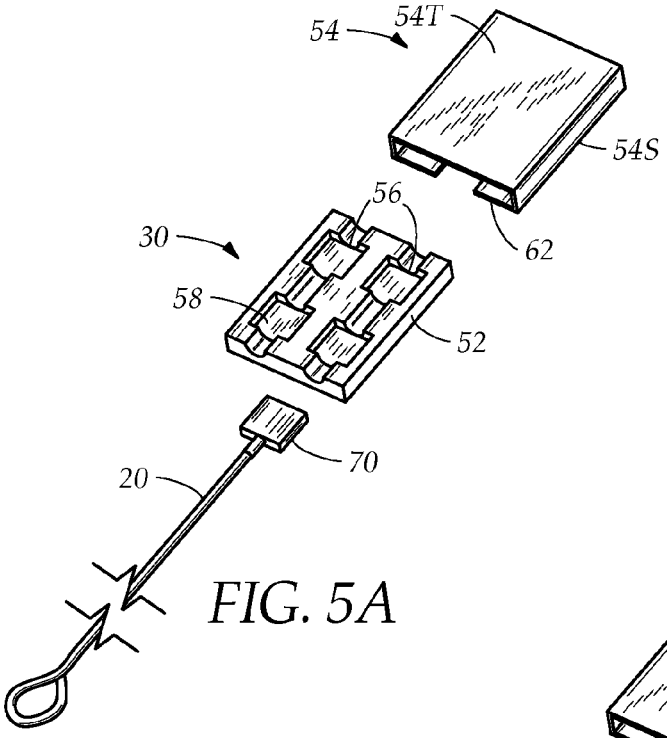
FIG. 5A is a diagrammatic perspective view of a disassembled clip in one embodiment and an elastic cord tab.
Figure 5B:
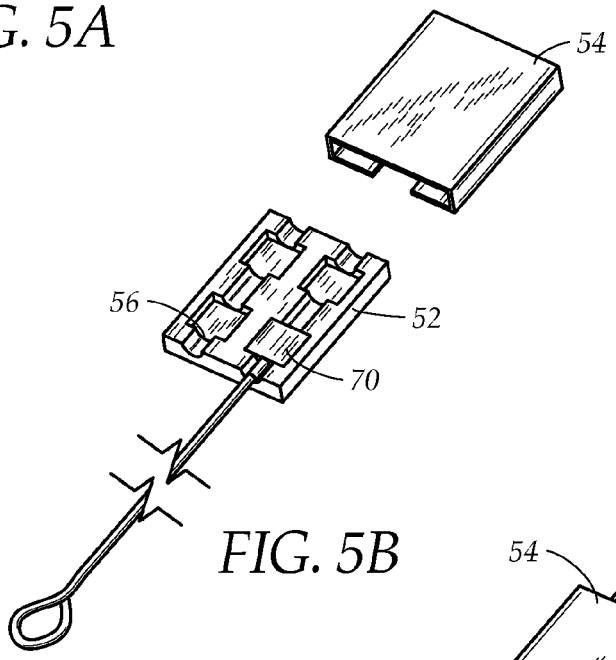
FIG. 5B, similar to FIG. 5A, is a diagrammatic perspective view of the disassembled clip in one embodiment, with the elastic cord tab inserted into the clip.
Figure 5C:
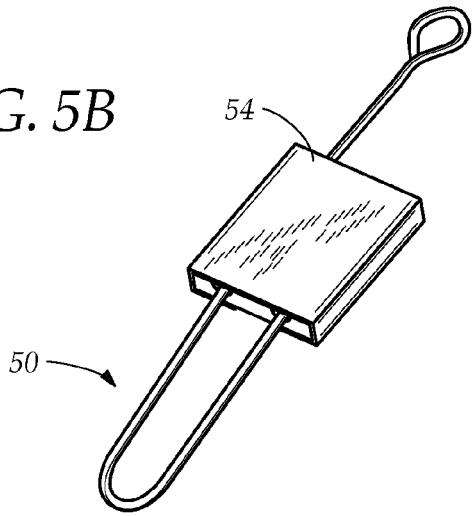
FIG. 5C, similar to FIG. 5B, is a diagrammatic perspective view of the assembled clip with the elastic cord tab locked into the clip.

FIG. 5A, FIG. 5B and FIG. 5C show a further embodiment of the clip 30. FIG. 5A shows the clip having a frame 52 and a separate sliding cover 54, the frame having a pair of grooves 56, each groove having a pair of slots 58. The cover has a top 54T and a pair of side walls 54S, the walls wrapping around opposite the top, forming a pair of channels 62, the channels selectively engaging the frame when the cover slides onto the frame.

In this embodiment, the first end of the elastic cord 20 has a cliptab 70, the cliptab 70 inserting into a slot 58. In yet a further embodiment, which is not illustrated, both ends of the cord each have the cliptab, a pair of clips used to secure both cord ends. To close the clip, as illustrated in FIG. 5B, the cliptab 70 is selectively placed into a slot 58. The loop 50 is formed by placing the cord 20 in the adjacent groove 56. The cover 54 slides over the frame, covering the slot and locking the loop 50, preventing removal of the cliptab 70 from the slot, as demonstrated in FIG. 5C.

An outdoor umbrella stabilizer system is installed on the outdoor umbrella as described hereinbelow and illustrated in FIG. 2. The umbrella 102B is unfurled, the ribs 104 fully extended. A user inserts the proximal end 20P of the elastic cord 20 between one rib 104 and the canopy edge 102E around the tip 108 of the umbrella. The user forms the loop 50 and secures the loop with the clip 30, securing the elastic cord to the umbrella 100B.

The user secures the distal end 20D of the cord to the weighted object. In one embodiment, the user secures the distal end of the cord to the sac 40, by inserting the end into the casing of the sac before securing the proximal end to the umbrella canopy 102. The user places ballast inside the sac. The user passes the proximal end through the annulus on the distal end and pulls the proximal end, decreasing the loop and closing the sac. The user then inserts the proximal end between the rib 104 and the canopy edge 102E, forming the loop 50, and securing the loop with the clip 30. The user selectively places the remaining cords, following the method described hereinabove, placing the cords angularly equidistant around the edge of the canopy. In one example embodiment, four cords are placed at ninety degrees to each other. In another example embodiment, three cords are placed at one-hundred twenty degrees to each other.

In a further embodiment, the user secures the distal end 20D of the cord to the sac 40 by inserting the distal end into the casing forming an open loop, placing ballast inside the sac, pulling the proximal end thereby decreasing the loop and closing the sac and securing the loop with a clip on the distal end. The user secures the proximal end 20P to the umbrella 100B. The user continues to place the cords angularly equidistant from each other as explained hereinabove.

An outdoor umbrella stabilizer system is installed on outdoor umbrella accommodated by the center hole in a table as described hereinbelow and illustrated in FIG. 1. The umbrella 100 is unfurled, the ribs 104 fully extended. As explained hereinabove, the user inserts the proximal end 20P of the elastic cord between one rib 104 and the canopy edge 102E around the tip of the umbrella. The user loops the cord, forming the loop 50 and secures the elastic cord 20 to the umbrella with a clip 30. The user secures the distal end 20D of the cord to the weighted object, the table 120. In one embodiment, the user secures the distal end of the cord to the table leg by taking the distal end forming the loop 50 around the leg 122 and securing the loop with the clip. The user selectively places the remaining sets, selectively placing one cord on each table leg and angularly equidistant from each other, following the method described hereinabove In a further embodiment, the user loops the distal end 20D of the cord around the table leg 122 before securing the proximal end 20P to the umbrella canopy 102. The proximal end 20P is inserted into the annulus on the distal end and tightened around the leg 122. The user then inserts the proximal end between the rib 104 and the canopy edge 102E, forming the loop 50, and securing the loop with the clip 50. The user selectively places the remaining sets, following the method described hereinabove.

The user selectively secures the cord with the clip 30 by inserting the end of the cord into the clip, forming a loop and then engaging the clip again. The loop is selectively formed to secure the cord around a table leg, through the casing of the sac, or between the rib and canopy edge. As shown in FIG. 8, the user has a cord 20 with a annulus 22 on the end, placing the annulus at the end cord on the J-hook 34, inserts the end into the aperture 32, forms the loop 50 and then engages the T-bar 36 by wrapping the cord around at least one T-bar 36 and selectively wrapping the cord 20 around another T-bar 36 to secure the cord.

In a further embodiment of the clip shown in FIG. 7, the user has the cord with a plain end. The user inserts the end into the first opening 38F on the first row on the first side through to the second side, into the second opening 38S on the second side back through to the first side and selectively continues to the further openings in the first row, alternating the first side and the second side. The user forms the loop 50 and then inserts the end into the last opening 38L on the second row on the first side through to the second side, into another opening 38A on the second side back through to the first side and selectively continues through the openings in the second row.

In another embodiment of the clip 30, the user has the cord 20 with a cliptab 70 as shown in FIGS. 5A, 5B and 5C. The user inserts the cliptab 70 into the slot 58 in the first groove 56 and then forms the loop. The user inserts the cord 20 into the second groove in an opposing direction, places the cover 54 over the frame 52, locking the cord in place.

In this discussion, a configuration has been described that the clip locks the proximal end of the cord in place and that the distal end of the cord is either locked with a clip or with a single turn half-hitch knot formed with the annular loop. It is understood by those of ordinary skill that the cord end with the annular loop is usable at the proximal end, with a single turn half-hitch knot in a further configuration. Variations in the configuration of the cord engaging the umbrella and the weighted object are possible within the concepts of this disclosure.

In conclusion, herein is presented an outdoor umbrella stabilizer system. The disclosure is illustrated by example in the drawing figures, and throughout the written description. It should be understood that numerous variations are possible, while adhering to the inventive concept. Such variations are contemplated as being a part of the present disclosure.

What is claimed is:

1. An outdoor umbrella stabilizer system, for an outdoor umbrella having a canopy with an edge, a plurality of ribs with distal ends, and a plurality of tips, each tip being at a distal end of one of the ribs, the canopy extended by the ribs, the canopy edge attaching to the tips, the system comprising:

a plurality of sets, each set having an elastic cord, at least one clip, a circular sac, and a means for attaching a first loop formed by a second distal end of the cord to the sac;

said at least one clip having a top, a bottom, a side, and at least one aperture, a J-hook on the top and at least one T-bar on the side;

said elastic cord having a pair of ends, wherein an annulus is located at a first distal end and the circular sac is located at said second distal end, said circular sac comprises a ballast disposed inside, said sac having a circumferential perimeter and a casing attached along the perimeter, the second distal end of the elastic cord being inserted through the casing to form said first loop, the first loop cinching said sac closed after the ballast is placed inside the sac;

wherein the annulus is looped over said J-hook, and a portion of the elastic cord adjacent to the annulus is inserted into the at least one aperture and between the umbrella canopy and an umbrella rib to form a second loop around one of the tips, said cord also being wrapped around said at least one T-bar, thereby flexibly securing the cord to the umbrella;

wherein each of the plurality of sets attach to the canopy edge of the umbrella, the sets angularly equidistant from each other such that a number of degrees between each set is the same, the sets flexibly maintaining the umbrella in position, preventing a strong wind from catching the umbrella and twisting and deforming the umbrella, thereby stabilizing the outdoor umbrella.

2. An outdoor umbrella stabilizer system for an outdoor umbrella having a canopy with an edge, a plurality of ribs with distal ends, and a plurality of tips, each tip being at a distal end of one of the ribs, the canopy extended by the ribs, the canopy edge attaching to the tips, the system comprising:

a plurality of sets, each set having a circular sac with an elastic cord and at least one clip, the clip having a top, a bottom, a side, at least one aperture, a J-hook on the top and at least one T-bar on the side, said cord having a first distal end and a second proximal end, wherein an annulus is located on said first distal end of the cord and the sac is located at the second proximal end, the annulus of said cord being looped over the J-hook, and a portion of the cord adjacent to the annulus is inserted into the at least one aperture and between the umbrella canopy and an umbrella rib forming a loop around the tip, the clip flexibly attaching the cord loop and securing the cord to the umbrella, said cord also wrapping around the at least one T-bar to flexibly secure the cord, the sets attaching to the canopy edge of the umbrella, wherein the sets are angularly equidistant from each other such that a number of degrees between each set is the same, the sets flexibly maintaining the umbrella in position, preventing a strong wind from catching the umbrella and twisting and deforming the umbrella, the plurality of sets thereby stabilizing the outdoor umbrella.

* * * * *